United States Patent [19]

Leimbacher et al.

[11] 4,088,440

[45] May 9, 1978

[54] TRANSFER PRINTING OF TREATED CELLULOSICS

[75] Inventors: Erwin Leimbacher; Otto Siegrist; Alfred Steiger, all of Wattwil, Switzerland

[73] Assignee: Heberlein Textildruck AG, Wattwil, Switzerland

[21] Appl. No.: 682,672

[22] Filed: May 3, 1976

Related U.S. Application Data

[63] Continuation of Ser. No. 493,478, Jul. 31, 1974, abandoned.

[30] Foreign Application Priority Data

| | | |
|---|---|---|
| Aug. 3, 1973 | Switzerland | 11291/73 |
| Jun. 11, 1974 | Switzerland | 7922/74 |
| Jun. 18, 1974 | Switzerland | 8296/74 |

[51] Int. Cl.[2] ..... D06P 5/00; D06P 5/20

[52] U.S. Cl. ..... 8/2.5 A; 8/2.5 R

[58] Field of Search ..... 8/2.5 A, 2.5 R

[56] References Cited

U.S. PATENT DOCUMENTS

| | | | |
|---|---|---|---|
| 2,911,280 | 11/1957 | Cicogna | 8/2.5 |
| 3,666,397 | 5/1972 | Datye et al. | 8/2.5 |
| 3,782,896 | 1/1974 | DeFago et al. | 8/2.5 |
| 3,788,804 | 1/1974 | Harper et al. | 8/18 |

FOREIGN PATENT DOCUMENTS

| | | | |
|---|---|---|---|
| 1,957,262 | 9/1970 | Germany | 8/2.5 UX |
| 2,045,465 | 6/1971 | Germany | 8/2.5 UX |
| 327,404 | 3/1958 | Switzerland | 8/2.5 UX |
| 460,695 | 4/1968 | Switzerland | 8/2.5 UX |

OTHER PUBLICATIONS

Lutzel, Journ. Soc. Dyers and Colourists, 82, (8) pp. 293–299 (1966).

Salvin, V. S., The Sublimation Problem in Permanent Press Finishing, American Dyestuff Reporter, pp. 31–35 (6-5-67).

*Primary Examiner*—Stanford M. Levin

*Attorney, Agent, or Firm*—Fitzpatrick, Cella, Harper & Scinto

[57] ABSTRACT

Process for dry dyeing and printing of flat textile fabrics containing cellulose fibers with a cross-linking treatment of those fibers in which the fabric is treated with an aqueous solution of cross-linking agents, and auxiliary agents is dyed or printed after pre-drying according to the transfer printing process in dry condition with sublimable dyestuffs and is heated in the presence of an acid or potentially acid catalyst.

43 Claims, No Drawings

TRANSFER PRINTING OF TREATED CELLULOSICS

This is a continuation, of application Ser. No. 493,478 filed July 31, 1974, now abandoned.

The present invention relates to a process for the treatment of textile fabrics, and more particularly, to a process for the combined dyeing or printing and finishing of textile fabrics or flat structures consisting entirely or partially of cellulose fibers with cross-linking agents.

A method for dyeing and printing textile fabrics in dry condition is known and consists in transferring to the textile material sublimable or vapourizable dyestuffs, particularly dispersion dyestuffs, from a support which has been coated with the dyestuff, preferably from a sheet of support paper. The support material coated with the dyestuffs is applied to the textile material and heated by means of a press or a calender whereby the dyestuffs are brought into the gaseous state and are fixed on the textile material. It is essential here that the fiber material should have good affinity for the vapours of the dyestuffs. Thus far, from a practical standpoint it has been possible to use this method for dyeing and printing of textile materials consisting only of synthetic fiber material such as polyamides and polyesters, whereas, textile materials made from natural fibers such as cotton or wool, could not be dyed satisfactorily.

We have conceived a process, according to the present invention, which overcomes the foregoing difficulties and by which we are able to dye or print and finish textile materials composed of or containing cellulose fibers. Thus, according to the present process, we provide a process for the dry dyeing and printing of flat textile structures containing cellulose fibers in combination with a cross-linking treatment of the cellulose fibers. The process of the present invention is therefore characterized in that the textile material is treated with the aqueous solution of cross-linking agents for the cellulose, is dyed or printed after pre-drying in dry condition with sublimable dyestuffs, according to the transfer printing process and at the same time or thereafter is subjected to heat treatment in the presence of an acid or potentially acid catalyst for wash-resistant fixation of the cross-linking agent.

It is possible by the process of our present invention to produce cellulose-containing woven or knitted fabrics and of wearing apparel manufactured therefrom which present improved dimensional stability, crease-resistance and pressfree and durable press finish and on which dyestuffs which have been applied according to the transfer printing process, have been fixed so that they resist washing treatments.

For producing durable press wearing apparel, the flat textile structure, after dyeing or printing, can be subjected to shaping such as, for example, the formation of pleats and confection wearing apparel, and only thereafter to heat treatment for wash-resistant fixation of the cross-linking agents, which heat treatment can be effected in two steps and consist, for example, of heating to a temperature of between 100° and 130° C before shape modification or confection and to a heat treatment at a temperature of between 150° and 180° C after shape modification or confection.

As cross-linking agents for the cellulose, so-called reactants are primarily suitable, i.e., products which do not form resins in the conventional sense, but react with the hydroxy groups of the cellulose by forming bridges, such as acetals, for example reaction products of formaldehyde and diethylene glycol, dimethylol monocarbamates, for example dimethylol methyl carbamate, dimethylol urea and cyclic dimethylol urea compounds such as dimethylol compounds of ethylene urea, dihydroxy ethylene urea, propylene urea and its derivatives, triazones such as dimethylol 5-methoxyethyl-1,3,5-triazinone-2, methylol melamine compounds such as tetramethylol melamine or water-soluble etherified methylol melamine compounds, epoxides such as diglycidyl ether of ethylene glycol. Other suitable cross-linking agents are aldehydes such as formaldehyde, glyoxal, glutaraldehyde, furthermore epichlorhydrin, divinyl sulfonic derivatives and tris- (1-aziridinyl) -phosphine oxide, or hexamethylene diethylene urea.

Suitable acid or potentially acid catalysts are for example, magnesium chloride, diammonium sulfate, zinc nitrate, zinc chloride, magnesium nitrate. In certain cases, such as when using divinyl sulfone derivatives as cross-linking agents, it is possible to add to the cross-linking agent solution alkaline catalysts such as soda.

Catalysts which promote cross-linking only at higher temperatures or after prolonged heat treatment, such as magnesium chloride, may be added to the solution of the cross-linking agent. Furthermore, the catalysts can be added to the solution of the cross-linking agents together with an agent retarding their effect such as ammonium salts, for example ammonium acetate. Finally, a solution of the catalysts can be applied to the flat textile structure after dyeing or printing.

As dyestuffs for effecting the process of the present invention, sublimable dyestuffs with reactive hydroxy, amino, amide, sulfo or carboxy groups have proven particularly suitable.

Also auxiliary agents having dyestuff-receptive and reactive groups may be added to the solution of the cross-linking agent, such as dispersions of polyacrylic acid derivatives having free carboxy groups or modified polyvinyl alcohol derivatives.

The process of the present invention can be applied to flat textile structures containing cellulose fibers, such as woven or knitted fabrics, furthermore non-woven, and particularly on woven and knitted fabrics of cotton or regenerated cellulose and mixtures of cotton or regenerated cellulose with synthetic fibers, particularly polyester fibers.

The present invention will be understood in more detail by reference to the following examples:

EXAMPLE I

A mercerized and bleached cotton fabric was impregnated with an aqueous solution, containing 200g of dihydroxydimethylol ethylene urea and 30g of a reactive polyacrylic acid ester, per liter, and was squeezed, whereby the material absorbed 75 weight percent of liquid of the weight based on the dry material, and was pre-dried at approximately 100° C. A support paper was applied which had been design-printed with Artisil scarlet GP, dyestuff produced by Sandoz AG, of Basel, Switzerland (Colour Index No. 11 118) and cellion fast blue FR, dyestuff produced by BASF, Ludwigshafen, Germany (Colour Index No. 61 115), and the dyestuffs transferred to the fabric by means of a pressing machine, the contact time being 15 seconds at a temperature of 240° C. Thereafter, the fabric was impregnated with an aqueous solution containing 10g of zinc nitrate per liter and dried at approximately 100° C.

The fabric was then cut, sewed together to form a piece of wearing apparel, pressed at a temperature lower than 100° C, pleats being applied, and finally heated in an oven having a temperature of between 150° and 180° C for between 3 and 4 minutes. The thus treated piece of wearing apparel had good wash-and-wear properties and wash-resistant pleats, and the colour print design was also wash-resistant.

EXAMPLE II

A mercerized and bleached mixed fabric containing 33% of cotton and 67% of polyester fibers was impregnated with a solution containing 160g of Lyofix CHN (amino-triazineformaldehyde precondensate) and 8g of magnesium chloride, per liter, and squeezed, whereby the fabric absorbed the liquid in an amount of 75% of the weight of the dry material and was predried at approximately 100° C. A support paper was applied which had been coated on its entire surface with artisil brillant pink SBP, dyestuff of Sandoz AG (Colour Index No. 62015), and the dyestuff transferred to the fabric by means of a calendering machine for 20 seconds at a temperature of 220° C.

The thus treated fabric showed good dimensional stability, and the colouration resisted laundry treatment.

EXAMPLE III

A mercerized and bleached cotton fabric was impregnated with an aqueous solution containing 240g of Knittex everfit CR (dimethylol ethylene urea aminotriazine formaldehyde precondensate), 20g of zinc nitrate and 10g of ammonium acetate, per liter, was squeezed and predried. A support paper was applied which had been design-printed with Artisil direct blue-green, dyestuff of Sandoz AG (Colour Index No. 62500) and with artisil scarlet GP, dyestuff of Sandoz AG (Colour Index No. 11118), and the dyestuffs transferred to the fabric during 20 seconds at 220° C by means of a pressing machine. Thereafter, the fabric was heated in an oven to 160° C for 2.5 minutes. The thus obtained fabric had good crease-resistant and wash-wear properties and the colour-print resisted laundering.

According to a modification of our invention, and as a further development of the foregoing process, we contribute a measure which may be taken for improving the dyestuff receptivity of the textile material or of dyestuff fixation. This measure is characterized in that metal salts of polycarboxylic acids alone or in combination with inorganic acid metal salts are used as cross-linking catalysts.

As metal salts of polycarboxylic acids, magnesium, zinc, aluminum, zirconium, iron, nickel, copper and sodium salts of ethylene diamine tetraacetic acid, of nitrilo triacetic acid, and of diethylene triamine pentaacetic acid, have proven suitable. Particularly suitable is the dimagnesium salt of ethylene diamine tetraacetic acid.

As the inorganic acid metal salts which can be used in combination with the metal salts of polycarboxylic acids, for example magnesium chloride, zinc chloride or diammonium sulfate are suitable.

The present modification will be understood in more detail by reference to the following examples:

EXAMPLE IV

A cutting of a mercerized and bleached cotton fabric (sample 1) was impregnated with an aqueous solution, containing, per liter:

150g of Lyofix CHN (amino-triazine-formaldehyde precondensate)
12g of the dimagnesium salt of ethylene diamine tetraacetic acid
100g of Hydrophobol Z-78 (hydrophobating agent on the base of paraffin emulsion with zirconium salt)
60g of Styrophan (polystyrene dispersion). squeezed and predried.

A further cutting of the same fabric (sample 2) was impregnated with the same solution, containing however, as a catalyst, instead of the dimagnesium salt of ethylene diamino tetraacetic acid, 8g of magnesium chloride, squeezed and predried.

Onto both samples 1 and 2, a support paper having been design-printed with artisil direct blue-green, dyestuff of Sandoz AG (Colour Index No. 62500) and with artisil scarlet GP, dyestuff of Sandoz AG (Colour Index No. 11118), was applied and the dyestuffs transferred to the fabric cuttings during 20 seconds at 240° C by means of a pressing machine.

The thus obtained samples were examined as to their wash-fastness after five washing treatments in a household laundering machine at 60° C using a fine commercial available laundry agent. Evaluation of sample 1 gave a level of 5 and evaluation of sample 2 a level of 2–3 on a grading scale of 1 to 5 for evaluating wash-fastness of dyestuffs wherein 1 = very low; 2 = low; 3 = mean; 4 = above average; and 5 = good.

EXAMPLE V

A mercerized and bleached mixed fabric containing 50% each of cotton and of polyester fibers was impregnated with an aqueous solution, containing, per liter:

150g of Lyofix CHN
6g of magnesium chloride
6g of the dimagnesium salt of ethylene diamino tetraacetic acid
100g of Pigmenton (reactive acrylic acid ester dispersion), squeezed and predried. A support paper having been coated on its whole surface with artisil brillant pink SBP, dyestuff of Sandoz AG (Colour Index No. 62015), was applied to the thus pretreated fabric and the dyestuff transferred to the fabric during 20 seconds at 220° C by means of a calendering machine. Thereupon the fabric was heated to 160° C for 2.5 minutes. The thus obtained fabric had good crease-resistant and wash-wear properties and a brilliant, wash-fast colouration.

We have found another measure which may be taken for improving the dyestuff receptivity of the textile material and the dyestuff fixation, and this measure is characterized in that aromatic compounds or halogen derivatives of the same or non-ionic oxyalkylated compounds may be added separately or in combination as dyeing auxiliary agents.

In using such dyeing auxiliary agents, we were surprised to note a definite colour deepening influence even on textile flat structures consisting entirely of cellulose fibers. Furthermore, it is apparent that they obviously maintain increased mobility of the condensed dyestuff molecules and therefore decisively increase the probability of reaction between the dyestuff and its reactive substituents and the cross-linking agent to be fixed. Thereby, an essentially improved fastness of the prints or dyeings is obtained.

As aromatic compounds or halogen derivatives thereof, particularly aromatic hydrocarbons, such as, for example, diphenyl; multinuclear phenols such as for example, phenyl phenoles; aromatic ethers, for example diphenyl ether; or aromatic carboxylic acid esters, for example terephthalic acid dimethyl ester, come into consideration. Furthermore halogenated hydrocarbons, particularly chlorine hydrocarbons are suitable. As non-ionic compounds, alkyl-arylethoxylate mixtures, non-ionic fatty acid derivatives, ethoxylated nonyl phenol, fatty alcohol polyglycol ether, or modified phosphoric acid esters may be used.

The following examples will facilitate an understanding of this aspect of our invention:

EXAMPLE VI

A cutting of a mercerized and bleached cotton fabric (sample 1) was impregnated with an aqueous solution containing, per liter:

150g of "lyofix" CHN (amino triazine formaldehyde precondensate)
150g of "Chemocarrier special" (chlorinated aromatic hydrocarbon)
8g of magnesium chloride
50g of "pigmenton" (reactive acrylic acid ester dispersion), squeezed and predried.

A further cutting of the same fabric (sample 2) was impregnated with the same solution which, however, did not contain any "Chemocarrier special", squeezed and predried.

A support paper which has been design-printed with Artisil direct blue-green, dyestuff of Sandoz AG (Colour Index No. 62500) and with Artisil scarlet GP, dyestuff of Sandoz AG (Colour Index No. 11118) was applied to these two cuttings and the dyestuffs transferred to the fabric cuttings for 20 seconds at 240° C by means of a pressing machine.

The samples thus obtained are examined for their wash-fastness after five washing treatments in a household washing machine with the solution of a usual fine washing agent at 60° C. Evaluation of sample 1 gave a level of 4, and for sample 2, a level of 2–3.

EXAMPLE VII

A mercerized and bleached cotton fabric was impregnated with a solution containing, per liter:

150g of Lyofix CHN
142g of Protegal TE (non-ionic fatty acid derivative)
8g of magnesium chloride, squeezed and predried. A support paper having been coated on its entire surface with artisil brillant pink SBP, dyestuff of Sandoz AG (Colour Index No. 62015), was applied to the thus treated fabric, and the dyestuff transferred to the fabric during 20 seconds at 240° C by means of a calendering machine. The fabric thus obtained had good crease-resistant properties and a deep, wash-resistant fixed colouration.

EXAMPLE VIII

A mercerized and bleached cotton fabric was impregnated with an aqueous solution containing, per liter:

150g of Lyofix CHN
150g of Samaron fixing agent HT (alkyl aryl ethoxylate mixture)
10g of zinc chloride, squeezed and predried. To the thus pretreated fabric, a design-printed support paper was applied as described in Example VI and the dyestuffs transferred to the fabric. An intense-coloured print of good wash-fastness and with good crease-resistant and wash-wear properties was thus obtained.

EXAMPLE IX

A mercerized and bleached mixed fabric consisting of 50% each of cotton and polyester fibers was impregnated with an aqueous solution containing, per liter:

150g of Lyofix CHN
75g of Chemocarrier special
75g of Samaron fixing agent HT
8g of magnesium chloride, squeezed and predried and, as described in Example VII, dyed according to the transfer method by means of a transfer paper coated with the dyestuff. The fabric thus obtained had a deep colouration of good wash-fastness as well as good crease-resistant and wash-wear properties.

We believe that the practise of our novel process will now be understood, and that the advantages thereof will be fully appreciated by those persons skilled in the art.

We claim:

1. A process for the combined dyeing or printing and finishing of a textile consisting at least partially of cellulose fibers, which comprises:

(1) impregnating said textile with an aqueous solution containing:
  (a) a sufficient amount of a cross-linking agent capable of reacting with and cross-linking the hydroxy groups of the cellulose, and
  (b) a sufficient amount of at least one dyeing auxiliary agent which improves the dyestuff receptivity of said textile and the dyestuff fixation therein and which is selected from the group consisting of aromatic compounds, halogenated aromatic compounds and non-ionic oxyalkylated compounds:
(2) pre-drying the resulting impregnated textile;
(3) dyeing or printing the resulting predried textile in the dry state with sublimable dyestuffs by a transfer-printing process which comprises contacting the predried textile with the sublimable dyestuffs which have been coated onto a support paper and heating; and
(4) simultaneously with step (3) or thereafter subjecting the textile to heat treatment in the presence of a sufficient amount of an acidic or potentially acidic cross-linking catalyst to promote said cross-linking of said hydroxy groups and to produce wash-resistant fixation of the dyestuffs and the cross-linking agent in the fibers of the textile.

2. The process as claimed in claim 1, wherein said cross-linking agent is a member selected from the group consisting of the reaction product of formaldehyde and diethylene glycol, dimethylol methyl carbamate, dimethylol urea, dimethylol propylene urea, N-N-dimethylol-5-methoxyethyl-1, 3, 5-triazinone-2, tetramethylol melamine, etherified methylol melamine, the diglycidyl ether of ethylene glycol, formaldehyde, glyoxal, glutaraldehyde, epichlorhydrin, divinyl sulfonic derivatives, tris-(1-aziridinyl)phosphine oxide, and hexamethylene diethylene urea.

3. The process as claimed in claim 1, wherein said cross-linking agent, said auxiliary agent and said catalyst are all present in said aqueous solution.

4. The process as claimed in claim 3, wherein said cross-linking agent is present in said aqueous solution in a concentration of from 77 to 200 grams per liter of solution.

5. The process as claimed in claim 3, wherein the concentration of said cross-linking agent in said solution is from 77 to 200 grams per liter of solution, and wherein the concentration of said dyeing auxiliary agent in said solution is from 142 to 150 grams per liter of solution.

6. The process as claimed in claim 3, wherein said catalyst is magnesium chloride.

7. The process as claimed in claim 1, wherein said aqueous solution contains said cross-linking agent, said auxiliary agent, said catalyst and an agent which retards said cross-linking.

8. The process as claimed in claim 7, wherein the concentration of said agent which retards said cross-linking in said solution is 10 grams per liter of solution, and wherein the concentration of said catalyst in said solution is from 8 to 20 grams per liter of solution.

9. The process as claimed in claim 7, wherein said agent which retards said cross-linking comprises an ammonium salt.

10. The process as claimed in claim 9, wherein the agent which retards said cross-linking comprises ammonium acetate.

11. The process as claimed in claim 1, wherein said textile comprises a flat textile.

12. The process as claimed in claim 1, wherein said textile consists entirely of cellulose.

13. The process as claimed in claim 1, wherein said textile is composed of a mixture of cellulose fibers and synthetic fibers.

14. The process as claimed in claim 1, wherein said textile comprises a woven fabric.

15. The process as claimed in claim 1, wherein said textile comprises a knitted fabric.

16. The process as claimed in claim 1, wherein said textile comprises a non-woven fabric.

17. The process as claimed in claim 1, wherein said textile comprises a woven or knitted fabric composed of cotton or regenerated cellulose, or a mixture of synthetic fibers with cotton or regenerated cellulose.

18. The process as claimed in claim 1, wherein said pre-drying step (2) is conducted at a temperature of about 100° C.

19. The process as claimed in claim 1, wherein said aromatic compounds are selected from the group consisting of aromatic hydrocarbons, multinuclear phenols, aromatic ethers and aromatic carboxylic acid esters.

20. The process as claimed in claim 1, wherein said aromatic compounds are selected from the group consisting of diphenyl, phenyl phenoles, diphenyl ether and terephthalic acid dimethyl esters.

21. The process as claimed in claim 1, wherein said halogenated aromatic compounds are halogenated aromatic hydrocarbons.

22. The process as claimed in claim 1, wherein said halogenated aromatic compounds are chlorinated aromatic hydrocarbons.

23. The process as claimed in claim 1, wherein said non-ionic oxyalkylated compounds are selected from the group consisting of alkyl-aryl-ethoxylate mixtures, non-ionic fatty acid derivatives, ethoxylated nonyl phenol, fatty alcohol polyglycol ether and modified phosphoric acid esters.

24. The process as claimed in claim 1, wherein said heat treatment step (4) is conducted by contacting the textile, after said step (3), with an aqueous solution containing said catalyst and subjecting the resulting textile to heat treatment.

25. The process as claimed in claim 1, wherein said dyestuffs comprise sublimable dyestuffs having hydroxy, amino, amide or carboxy groups capable of reacting with the cross-linking agent.

26. The process as claimed in claim 1, wherein said cross-linking agent is a member selected from the group consisting of acetals, dimethylol monocarbamates, cyclic dimethylol urea compounds, triazones, methylol melamine compounds, epoxides, aldehydes, epichlorhydrin, divinyl sulfonic derivatives, tris- (1-aziridinyl)-phosphine oxide, and hexamethylene diethylene urea.

27. The process as claimed in claim 1, wherein said catalyst is a member selected from the group consisting of magnesium chloride, diammonium sulfate, zinc nitrate, zinc chloride, and magnesium nitrate.

28. The process as claimed in claim 7, wherein said agent which retards said cross-linking comprises an ammonium salt.

29. The process as claimed in claim 1, wherein said heat treatment step (4) is conducted in two steps.

30. The process as claimed in claim 1, wherein the textile is subjected to a heat treatment at a temperature of from 100° to 130° C. following said step (3), is then subjected to shape modification, and then to another heat treatment at a temperature of from 150° to 180° C.

31. A process for the combined dyeing or printing and finishing of a textile consisting at least partially of cellulose fibers, which comprises:

(1) impregnating said textile with an aqueous solution containing:

(a) from 77 to 200 grams per liter of solution of a cross-linking agent capable of reacting with and cross-linking the hydroxy groups of the cellulose, (b) from 142 to 150 grams per liter of solution of a dyeing auxiliary agent which improves the dyestuff receptivity of said textile and the dyestuff fixation therein and which is selected from the group consisting of aromatic compounds and non-ionic oxyalkylated compounds, and (c) a sufficient amount of an acidic or potentially acidic cross-linking catalyst to promote said cross-linking of said hydroxy groups;

(2) pre-drying the resulting impregnated textiles; and (3) contacting the resulting pre-dried textile in the dry state with a paper support containing sublimable dyestuffs having hydroxy, amino, amide or carboxy groups capable of reacting with the cross-linking agent, and heating to a temperature of from 100° to 240° C to transfer said dyestuffs from the support to the textile and to cross-link said hydroxy groups and provide wash-resistant fixation of said dyestuffs, and the cross-linking agent, in said textile.

32. The process as claimed in claim 31, wherein said cross-linking agent is selected from the group consisting of acetals, dimethylol monocarbamates, cyclic dimethylol urea compounds, triazones, methylol melamine compounds, epoxides, aldehydes, epichlorhydrin, divinyl sulfonic derivatives, tris- (1-aziridinyl)-phosphine oxide, and hexamethylene diethylene urea.

33. The process as claimed in claim 31, wherein said catalyst is selected from the group consisting of magnesium chloride, diammonium sulfate, zinc nitrate, zinc chloride, and magnesium nitrate.

34. The process as claimed in claim 31, wherein said heat treatment step (4) is conducted in two steps.

35. The process as claimed in claim 31, wherein said aqueous solution also contains an agent which retards said cross-linking.

36. The process as claimed in claim 35, wherein said agent which retards said cross-linking is an ammonium salt.

37. The process as claimed in claim 36, wherein said ammonium salt is ammonium acetate.

38. The process as claimed in claim 35, wherein said agent which retards said cross-linking is present in said solution in a concentration of 10 grams per liter of solution, and wherein said catalyst is present in said solution in a concentration of from 8 to 20 grams per liter of solution.

39. A process for the combined dyeing or printing and finishing of a textile consisting at least partially of cellulose fibers, which comprises:

(1) impregnating said textile with an aqueous solution containing:

(a) from 77 to 200 grams per liter of solution of a cross-linking agent capable of reacting with and cross-linking the hydroxy groups of cellulose;

(b) from 142 to 150 grams per liter of solution of at least one dyeing auxiliary agent which improves the dyestuff receptivity of said textile and the dyestuff fixation therein and which is selected form the group consisting of aromatic compounds, halogenated aromatic compounds and non-ionic oxyalkylated compounds; and (c) from 8 to 20 grams per liter of solution of a catalyst which promotes said cross-linking and which is selected from the group consisting of magnesium chloride, diammonium sulfate, zinc nitrate, zinc chloride, and magnesium nitrate;

(2) pre-drying the resulting impregnated textile, and (3) contacting the resulting pre-dried textile in the dry state with a paper support containing sublimable dyestuffs having hydroxy, amino, amide, or carboxy groups capable of reacting with the cross-linking agent, and heating to a temperature of from 100° to 240° C to transfer said dyestuffs from the support to the textile and to cross-link said hydroxy groups and provide wash-resistant fixation of said dyestuffs and the cross-linking agent in said textile.

40. The process as claimed in claim 39, wherein said cross-linking agent is selected from the group consisting of acetals, dimethylol monocarbamates, cyclic dimethylol urea compounds, triazones, methylol melamine compounds, epoxides, aldehydes, epichlorhydrin, divinyl sulfonic derivatives, tris- (1-aziridinyl)-phosphine oxide, and hexamethylene diethylene urea.

41. The process as claimed in claim 39, wherein said aqueous solution also contains an agent which retards said cross-linking.

42. The process as claimed in claim 41, wherein said agent which retards said cross-linking is an ammonium salt.

43. The process as claimed in claim 42, wherein said ammonium salt is ammonium acetate and wherein said ammonium salt is present in said solution in a concentration of about 10 grams per liter of solution.

* * * * *